US009858890B2

(12) United States Patent
Mizusako et al.

(10) Patent No.: US 9,858,890 B2
(45) Date of Patent: Jan. 2, 2018

(54) DRIVER UNIT FOR ELECTRO-OPTICAL DEVICE, ELECTRO-OPTICAL DEVICE, ELECTRONIC APPARATUS, AND METHOD FOR DRIVING ELECTRO-OPTICAL DEVICE THAT PERFORM OVERDRIVE PROCESSING

(71) Applicant: Seiko Epson Corporation, Tokyo (JP)

(72) Inventors: Kazuhisa Mizusako, Shiojiri (JP); Hiroyuki Hosaka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 516 days.

(21) Appl. No.: 13/726,898

(22) Filed: Dec. 26, 2012

(65) Prior Publication Data

US 2013/0169703 A1 Jul. 4, 2013

(30) Foreign Application Priority Data

Dec. 28, 2011 (JP) ..... 2011-287145

(51) Int. Cl.
*G09G 3/36* (2006.01)
*G09G 5/10* (2006.01)
*G09G 3/20* (2006.01)

(52) U.S. Cl.
CPC ..... *G09G 5/10* (2013.01); *G09G 3/3648* (2013.01); *G09G 3/2022* (2013.01); *G09G 3/3614* (2013.01); *G09G 2320/0252* (2013.01); *G09G 2340/16* (2013.01)

(58) Field of Classification Search
CPC ..... G09G 5/10; G09G 3/3648; G09G 3/2022; G09G 3/3614; G09G 2340/16; G09G 2320/0252
USPC ..... 345/690–699
See application file for complete search history.

(56) References Cited

U.S. PATENT DOCUMENTS

2007/0285377 A1* 12/2007 Yamazaki ..... G09G 3/3648 345/101
2008/0158212 A1 7/2008 Maruyama et al.
2008/0284707 A1 11/2008 Katagawa et al.
2009/0128525 A1 5/2009 Kotani
(Continued)

FOREIGN PATENT DOCUMENTS

JP 2005-309326 A 11/2005
JP 2008-116564 A 5/2008
(Continued)

*Primary Examiner* — Lisa Landis
(74) *Attorney, Agent, or Firm* — ALG Intellectual Property, LLC

(57) ABSTRACT

A liquid crystal display device is configured so that one frame is divided into two fields and a pixel of a liquid crystal panel is driven. The liquid crystal display device performs overdrive when a gray-scale level to be supplied to the pixel is different between a previous frame and a current frame. The liquid crystal display writes a voltage corresponding to the gray-scale level of the pixel with a positive voltage in a first field, and writes a voltage corresponding to the gray-scale level to be supplied to the pixel with a negative voltage in a second field. When performing overdrive, the liquid crystal display device performs overdrive in both of the first field and the second field. Also, when performing overdrive, the liquid crystal display device corrects the gray-scale level to be supplied to the pixel.

14 Claims, 8 Drawing Sheets

(56) References Cited

U.S. PATENT DOCUMENTS

2010/0079441 A1* 4/2010 Sasaki ..... G09G 3/3648
345/213

FOREIGN PATENT DOCUMENTS

JP 2008-165161 A 7/2008
JP 2009-128504 A 6/2009

* cited by examiner

FIG. 6

| VALUE AT AXIS | 0 | 1 | 2 | 3 | ... | 28 | 29 | 30 | 31 | 32 | 33 | 34 | ... | 61 | 62 | 63 |
|---|---|---|---|---|---|---|---|---|---|---|---|---|---|---|---|---|
| STORED CORRECTION AMOUNT | CORRECTION AMOUNT WHEN IMAGE DATA Cd = 0 | CORRECTION AMOUNT WHEN IMAGE DATA Cd = 64 | CORRECTION AMOUNT WHEN IMAGE DATA Cd = 128 | CORRECTION AMOUNT WHEN IMAGE DATA Cd = 196 | ... | CORRECTION AMOUNT WHEN IMAGE DATA Cd = 1792 | CORRECTION AMOUNT WHEN IMAGE DATA Cd = 1856 | CORRECTION AMOUNT WHEN IMAGE DATA Cd = 1920 | CORRECTION AMOUNT WHEN IMAGE DATA Cd = 1984 | CORRECTION AMOUNT WHEN IMAGE DATA Cd = 2048 | CORRECTION AMOUNT WHEN IMAGE DATA Cd = 2112 | CORRECTION AMOUNT WHEN IMAGE DATA Cd = 2176 | ... | CORRECTION AMOUNT WHEN IMAGE DATA Cd = 3904 | CORRECTION AMOUNT WHEN IMAGE DATA Cd = 3968 | CORRECTION AMOUNT WHEN IMAGE DATA Cd = 4032 |

64 64 64 64 64 64 64 64 64 64 64 64

DRIVER UNIT FOR ELECTRO-OPTICAL DEVICE, ELECTRO-OPTICAL DEVICE, ELECTRONIC APPARATUS, AND METHOD FOR DRIVING ELECTRO-OPTICAL DEVICE THAT PERFORM OVERDRIVE PROCESSING

BACKGROUND

1. Technical Field

The present disclosure relates to an overdrive technology for use in an electro-optical device.

2. Related Art

As a technology for increasing the response speed of liquid crystal in a liquid crystal display device, there is a technology called "overdrive technology." JPA-2009-128504, for example, describes a liquid crystal display device using this technology. In the liquid crystal display device, one frame is divided into a plurality of fields, and the liquid crystal is AC driven. Then, when a frame changes, overdrive processing is performed in the first field of a subsequent frame but is not performed in the other field(s) of the subsequent frame. This liquid crystal display device is also configured so that the polarity of a voltage to be applied to the liquid crystal is changed in the first field in each frame. Thus, the polarity of the voltage to be applied to the liquid crystal when overdrive is performed changes alternately between the positive polarity and the negative polarity in each frame.

In the liquid crystal display device described in JP-A-2009-128504, the polarity of the voltage to be applied to the liquid crystal when overdrive processing is performed is not fixed to one of the positive polarity and the negative polarity but alternately changes between the positive polarity and the negative polarity. Thus, as compared to a configuration in which the polarity of the voltage to be applied to the liquid crystal when overdrive processing is performed is fixed to one of the positive polarity and the negative polarity, it is considered that the probability of a DC voltage component being applied to the liquid crystal can be reduced.

However, in the case of a moving image, there might be cases where the gray-scale level does not change before and after a frame changes. If the gray-scale level does not change, overdrive processing is not performed. In this case, for example, after a voltage having the positive polarity is applied, a voltage having the negative polarity is not applied, and a DC component is applied to the liquid crystal. Also, in the liquid crystal display device of JPA-2009-128504, for a pixel, when the gray-scale level changes, the correction amount adopted when a voltage of the positive polarity is applied is not equal to the correction amount adopted when a voltage having the negative polarity is applied, and the correction amounts for overdrive might differ. For example, the correction amount adopted when a voltage having the positive polarity is applied is continuously larger than the correction amount adopted when a voltage having the negative polarity is applied, a DC voltage component is applied to the liquid crystal.

SUMMARY

Some aspects of the present disclosure are advantageous in that overdrive is performed while the probability of a DC component being applied to a pixel is reduced.

A driver unit for an electro-optical device according to an embodiment of the present disclosure is directed to a driver unit that drives an electro-optical device including a plurality of pixels and includes a signal processing section, a first image signal that designates a first gray-scale level is supplied to the signal processing section, a second image signal that designates a second gray-scale level is supplied to the signal processing section, the signal processing section corrects a third image signal that designates a third gray-scale level that is different from the first gray-scale level and the second gray-scale level to generate a first gray-scale signal and a second gray-scale signal each corresponding to the third image signal, supplies the first gray-scale signal to a first pixel among the plurality of pixels during a first period, and supplies the second gray-scale signal to the first pixel during a second period, one of the first gray-scale level and the second gray-scale level has a potential higher than a predetermined potential, and the other one of the first gray-scale level and the second gray-scale level has a potential lower than the predetermined potential.

According to an embodiment of the present disclosure, overdrive processing is performed in a positive field (a first field) and a negative field (a second field), and positive and negative voltages to be applied to a pixel by overdrive are symmetrical. Thus, overdrive may be performed while the probability of a DC voltage component being applied to the pixel is reduced.

In the electro-optical device, a configuration may be adopted in which a difference between the third gray-scale level and the first gray-scale level may be larger than a difference between the second gray-scale level and the first gray-scale level.

In the above-described configuration, overdrive is performed, and thus, the gray-scale level of the pixel may be changed at an increased speed.

Also, in the electro-optical device, a configuration further including an image signal storage section that stores the first pixel signal may be adopted.

The above-described configuration may facilitate processing of signals.

Moreover, in the electro-optical device, a configuration which further includes a correction amount storage section that stores correction amounts corresponding to the first gray-scale level and the second gray-scale level in advance and in which the signal processing section correct the second image signal and the third image signal on the basis of the correction amounts stored by the correction amount storage section may be adopted.

The above-described configuration may facilitate processing of signals.

Note that embodiments of the present disclosure can be conceptualized not only as an electro-optical device but also as a method for driving an electro-optical device. Moreover, embodiments of the present disclosure can be conceptualized as an electronic equipment including an electro-optical device.

BRIEF DESCRIPTION OF THE DRAWINGS

The invention will be described with reference to the accompanying drawings, wherein like numbers reference like elements.

FIG. 6 is a diagram illustrating a correction amount to be stored in the look-up table.

DESCRIPTION OF EXEMPLARY EMBODIMENTS

First Embodiment

Figure 1:
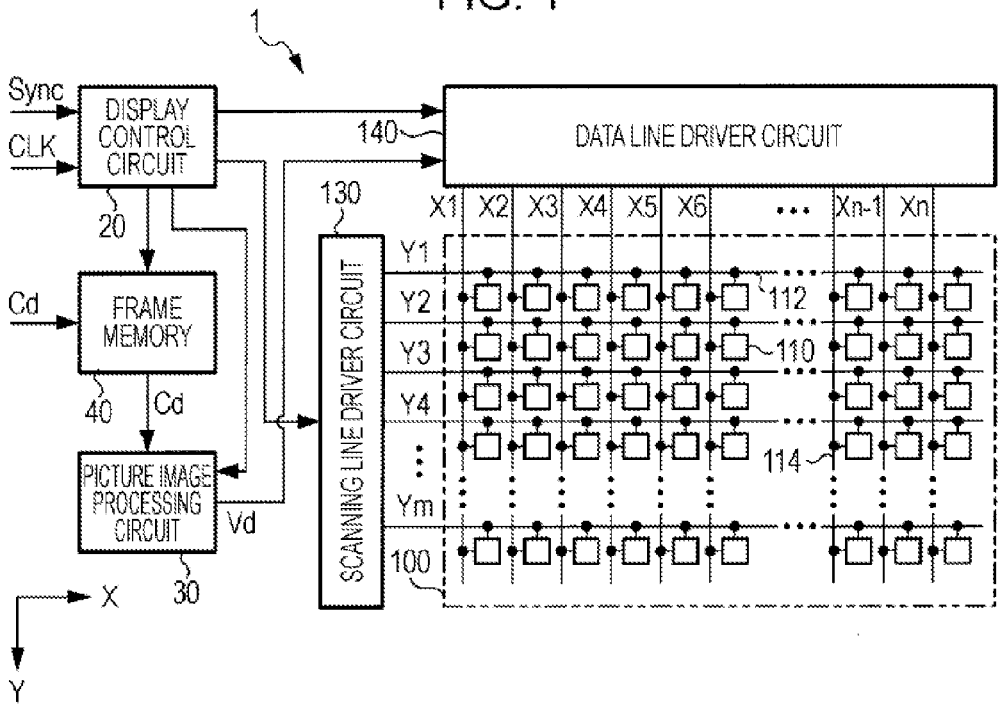
FIG. 1 is a block diagram illustrating a configuration of a liquid crystal display device.

FIG. 1 illustrates a block diagram illustrating a configuration of a liquid crystal display device 1 as an example of an electro-optical device according to an embodiment of the present disclosure. As illustrated in FIG. 1, the liquid crystal display device 1 includes a display control circuit 20, a picture image processing circuit 30 (a signal processing section), a frame memory 40, a liquid crystal panel 100, a scanning line driver circuit 130, and a data line driver circuit 140. The liquid crystal display device 1 is configured so that picture image data Cd that defines an image that is to be displayed on the liquid crystal panel 100 (a display panel) is supplied from a host circuit (not illustrated) to the liquid crystal display device 1 for each frame in accordance with a clock signal CLK and a synchronization signal Sync. Specifically, the picture image data Cd for one pixel is supplied in one cycle of the clock signal CLK, the picture image data Cd for pixels of one row is supplied during a horizontal scanning period defined by the synchronization signal Sync, and the picture image data Cd for one frame is supplied during a vertical scanning period defined by the synchronization signal Sync. Note that in this embodiment, the liquid crystal panel 100 is a normally black panel. The picture image data Cd is configured so that the gray-scale level of a single pixel is represented with a bits (the value of a is 12 in this embodiment), when the value is 0, black display in which the transmittance of light is minimum is performed, and when the value is 4095, white display in which the transmittance of light is maximum is performed.

The liquid crystal panel 100 is, for example, of the active matrix type. As illustrated in FIG. 1, the liquid crystal panel 100 includes scanning lines 112 of first to mth rows extending in a horizontal direction and data lines 114 of first to nth columns extending in a vertical direction and being electrically isolated from each of the scanning lines 112. Pixels 110 are provided so as to respectively correspond to intersections of the scanning lines 112 and the data lines 114.

Figure 2:
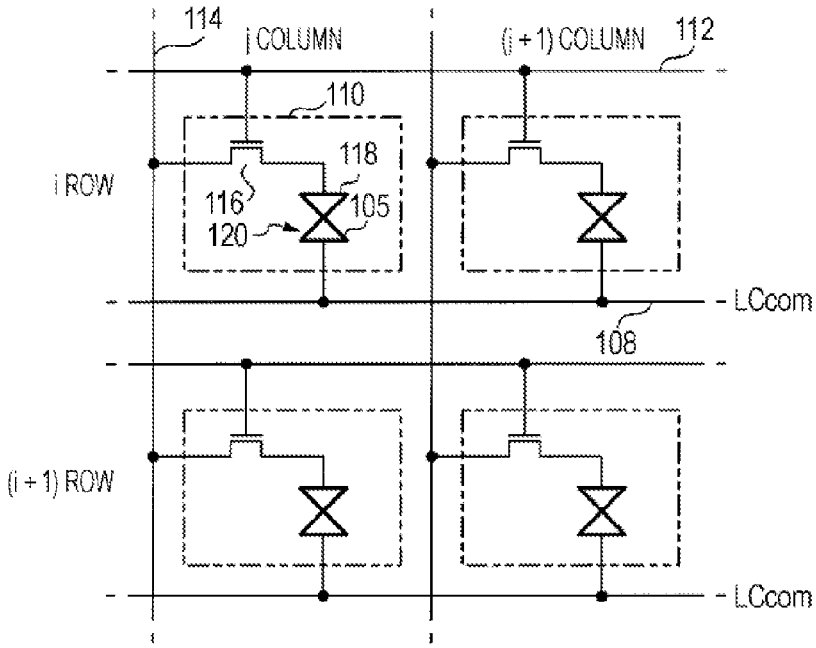
FIG. 2 is a diagram illustrating a configuration of a pixel.

An electrical configuration of the pixel 110 will be hereinafter described with reference to FIG. 2. As illustrated in FIG. 2, in the pixel 110, a pair of an re-channel thin film transistor (which will be hereinafter simply referred to as a "TFT") 116 and a liquid crystal element 120 is provided. A gate electrode of the TFT 116 is connected to a corresponding one of the scanning lines 112, a source electrode of the TFT 116 is connected to a corresponding one of the data lines 114, and a drain electrode of the TFT 116 is connected to a pixel electrode 118 which is one end of the liquid crystal element 120.

On the other hand, the other end of the liquid crystal element 120 is connected to a corresponding one of common electrodes 108, and a voltage LCcom is applied to the common electrode 108 by a circuit (not illustrated). Thus, the liquid crystal element 120 is configured so that a liquid crystal layer 105 is interposed between the pixel electrode 118 and the common electrode 108, a voltage corresponding to a potential difference between the pixel electrode 118 and the common electrode 108 is held, the orientation state of liquid crystal molecules changes in accordance with an electric field generated between the electrodes, and accordingly, the transmittance changes.

Returning to FIG. 1, the display control circuit 20 controls the operation of each section in accordance with the synchronization signal Sync provided from the host circuit. The display control circuit 20 generates a clock signal Cly, a polarity designating signal FRP, and a start pulse Dy indicating a start timing of a field, and outputs signals including the generated signals to other circuits.

Figure 3:
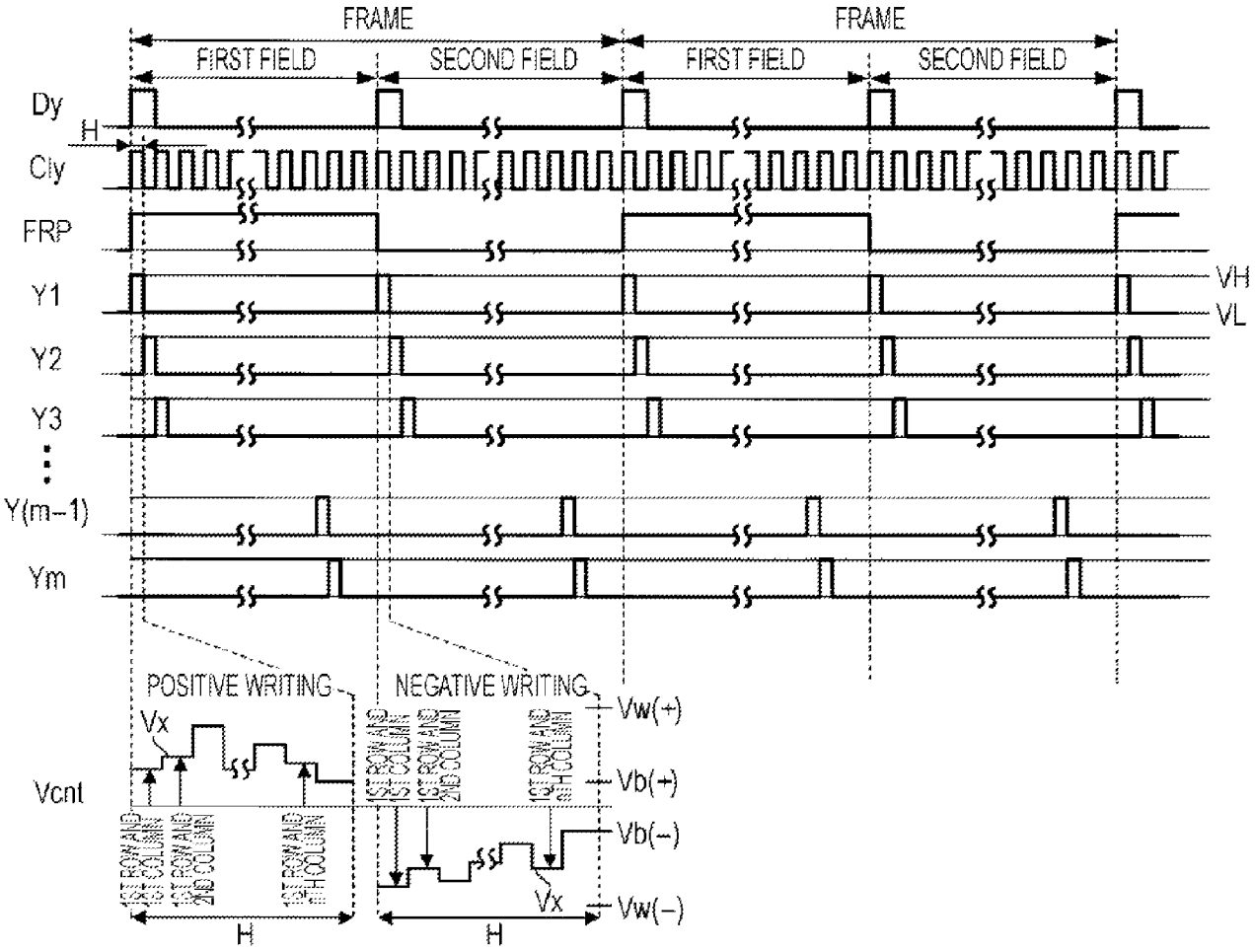
FIG. 3 is a timing chart of signals that drive a liquid crystal panel.

FIG. 3 is a timing chart illustrating the relationship among the voltage of each scanning line 112, the start pulse Dy, the clock signal Cly, the polarity designating signal FRP, and scanning signals Y1 to Ym for applying a selection voltage VH and a non-selection voltage VL to the scanning lines 112. As illustrated in FIG. 3, in the liquid crystal display device 1 of this embodiment, one frame is divided into 2n fields (n is an integer of 1 or larger), specifically, two fields, i.e., a first field and a second field. The term "frame" used herein means a period required to display an image of one film frame and, if the vertical scanning frequency of the synchronization signal Sync is 120 Hz, the frame is a number that is the inverse thereof, i.e., 8.3 ms. A period of one field corresponds to one half of the period of one frame and is about 4.16 ms herein.

In each field, the scanning lines 112 of the first to mth rows are sequentially selected. That is, in one frame period, each of the scanning lines 112 is selected twice. Thus, in the liquid crystal display device 1, double-speed driving is realized, and the liquid crystal display device 1 drives the liquid crystal panel 100 at a driving speed of 240 Hz on the basis of the picture image data Cd supplied from a host device at a supply speed of 120 Hz, thereby displaying an image of one film frame on the basis of the picture image data Cd.

The display control circuit 20 outputs the clock signal Cly whose duty ratio is 50%. In FIG. 3, a period of a half cycle of the clock signal Cly is denoted by H. The display control circuit 20 also outputs the start pulse Dy having a pulse width corresponding to one cycle of the clock signal Cly at rising edges of the clock signal Cly to the high level at which a frame (i.e., the first field) starts and also at which a period of one half of the frame has elapsed since the output of a preceding start pulse Dy.

When the start pulse Dy is supplied, the scanning line driver circuit 130 starts selection of the scanning lines 112. Then, each time the level of the clock signal Cly changes, the scanning line driver circuit 130 sequentially selects the scanning lines 112 in a plurality of rows in the order of the first row, the second row, the third row, . . . , and the mth row in the period of one field, applies a selection voltage VH to the selected scanning lines 112, and applies a non-selection voltage VL to the other scanning lines 112 which are not selected. The term "selection voltage" herein means a voltage which turns on the TFT 116 of the pixel 110 when being applied to the gate electrode of the TFT 116, and the term "non-selection voltage" herein means a voltage which does not turn on the TFT 116, i.e., turns off the TFT 116 even when being applied to the gate electrode of the TFT 116.

Also, the display control circuit 20 designates the polarity of a voltage to be applied to a liquid crystal by the polarity designating signal FRP. In this embodiment, the display control circuit 20 changes the level of the polarity designating signal FRP in each field. In the first field in which the polarity designating signal FRP changes to the high level, positive writing is performed in which a voltage having a potential higher than the reference voltage Vcnt is applied to the liquid crystal, while, in the second field in which the polarity of the polarity designating signal FRP changes to the low level, negative writing is performed in which a voltage having a potential lower than the reference voltage Vcnt is applied to the liquid crystal. That is, a writing polarity is inverted in each field and data writing to a pixel is performed. Note that the polarity designating signal FRP may be turned to the low level in the first field and to the high level in the second field.

Figure 4:
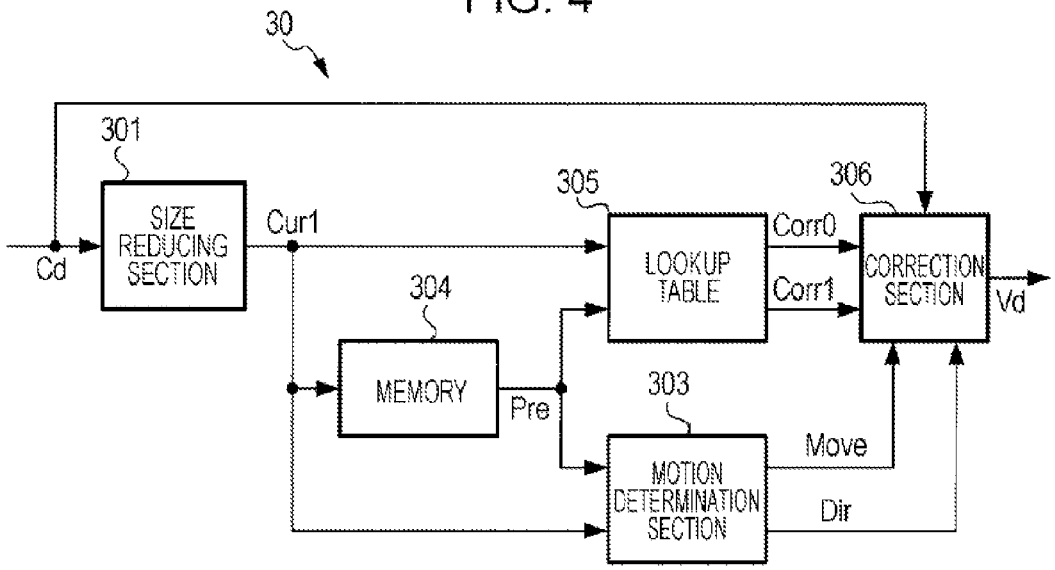
FIG. 4 is a block diagram illustrating a configuration of a picture image processing circuit.

The picture image processing circuit 30 performs overdrive processing on the picture image data Cd that designates the gray-scale level of the pixel 110 and outputs as picture image data Vd correction data that has undergone overdrive processing. FIG. 4 is a block diagram illustrating a configuration of the picture image processing circuit 30. As illustrated in FIG. 4, the picture image processing circuit 30 includes a size reducing section 301, a motion determination section 303, a memory (an image signal storage section) 304, a lookup table (a correction amount storage section) 305, and a correction section 306.

The size reducing section 301 obtains the picture image data Cd supplied from the host circuit. The size reducing section 301 extracts the b most significant bits from 12 bits of data of each pixel in the obtained picture image data Cd, and outputs the extracted b-bit data as data Cur1 (first data). Note that in this embodiment, the value of b is 6.

In accordance with control performed by the display control circuit 20, the memory 304 temporarily stores the data Cur1 outputted from the size reducing section 301 and reads out the stored data after a lapse of one frame to output the read-out data as data Pre. Thus, the data Pre designates the gray-scale level of a pixel of a preceding frame located immediately before a current frame as the data Cur1. Note that because the data Pre is data regarding the preceding frame located immediately before the current frame of the data Cur1, the picture image data Cd indicating an image to be displayed might be hereinafter referred to as an image data of the current frame.

The motion determination section 303 outputs data Move and data Dir. The motion determination section 303 receives the data Cur1 regarding the current frame outputted from the size reducing section 301. The motion determination section 303 also receives the data Pre that is data regarding the preceding frame located immediately before the current frame and is outputted from the memory 304. The motion determination section 303 compares the received data Cur1 with the received data Pre. If respective values of the data Cur1 and the data Pre are the same, the motion determination section 303 determines that the gray-scale level of the pixel in the current frame has not changed from that in the preceding frame located immediately before the current frame, sets the value of the data Move to be 0, and outputs the data Move. If the respective values of the data Cur1 and the data Pre are different, the motion determination section 303 determines that the gray-scale level of the pixel in the current frame has changed from that in the preceding frame located immediately before the current frame, sets the value of the data Move to be 1, and outputs the data Move. The motion determination section 303 compares the data Cur1 with the data Pre. If the data Pre≤the data Cur1, the motion determination section 303 determines that the gray-scale level of the pixel in the current frame has increased from that in the preceding frame located immediately before the current frame, sets the value of the data Dir to be 1, and outputs the data Dir. If the data Pre≥the data Cur1, the motion determination section 303 determines that the gray-scale level of the pixel in the current frame has decreased from that in the preceding frame located immediately before the current frame, sets the value of the data Dir to be 0, and outputs the data Dir.

The look-up table 305 is a two-dimensional lookup table that outputs data to be used for generating the picture image data Vd. The look-up table 305 receives the data Cur1 regarding the current frame outputted from the size reducing section 301 and the data Pre that is data regarding the preceding frame located immediately before the current frame of the data Cur1 and is outputted from the memory 304.

Figure 5:
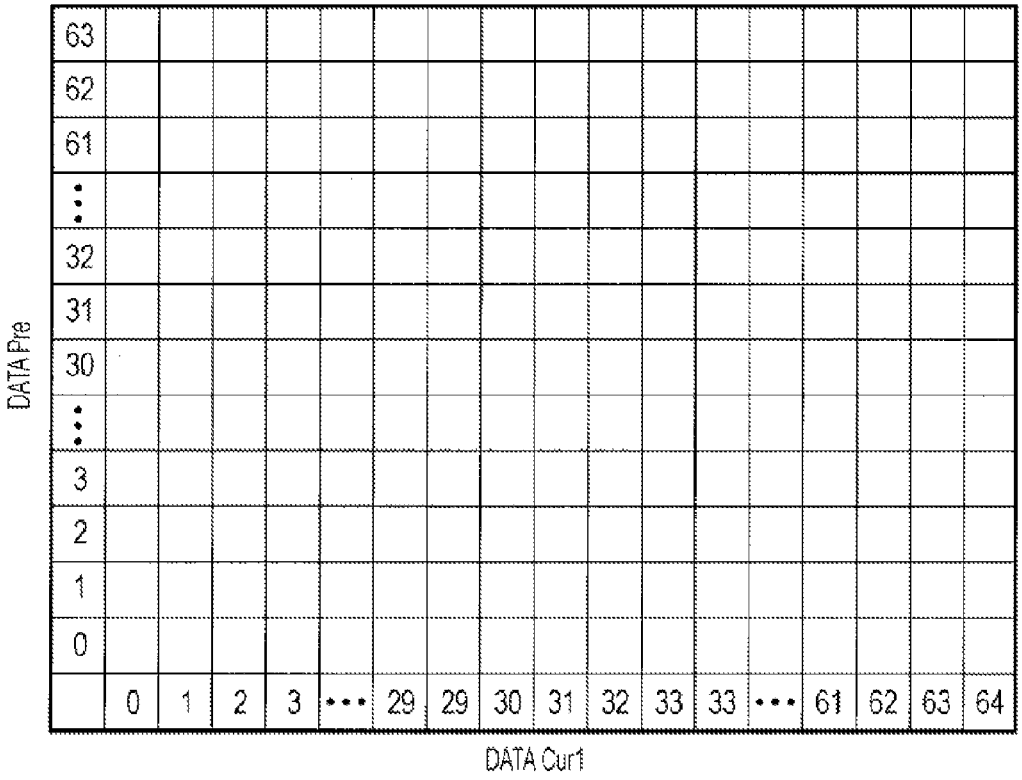
FIG. 5 is a diagram illustrating an example of a look-up table.

FIG. 5 is a diagram illustrating an example of the look-up table 305. In the look-up table 305, the abscissa axis corresponds to the data Cur1 and the ordinate axis corresponds to the data Pre. The look-up table 305 stores a correction amount to be used for correcting the picture image data Cd in accordance with each of combinations of the gray-scale level designated by the data Cur1 and the gray-scale level designated by the data Pre.

For example, when the value of the data Cur1 is 19 and the value of the data Pre is 10, the look-up table 305 outputs as data Corr0 a correction amount provided at an intersection of a column in which 19 is stored on the abscissa axis and a row in which 10 is stored on the ordinate axis and as data Corr1 a correction amount provided at an intersection of a column in which a value obtained by adding 1 to the data Cur1, i.e., 20 obtained by adding 1 to 19 is stored on the abscissa axis and a row in which 10 is stored on the ordinate axis.

Note that the correction amounts provided at rows and columns stored in the look-up table 305 represent correction amounts for predetermined gray-scale levels. Specifically, as illustrated in FIG. 6, a correction amount is stored every 64 gray-scale levels, a correction amount adopted when the value of the picture image data Cd of the current frame is 0 is stored in the 0 column on the abscissa axis, and a correction amount adopted when the value of the picture image data Cd of the current frame is 64 is stored in the 64 column on the abscissa axis. Moreover, a correction amount adopted when the value of picture image data Cd of the current frame is 128 is stored in the 2 column on the abscissa axis, and a correction amount adopted when the value of picture image data Cd of the current frame is 192 is stored in the 3 column on the abscissa axis.

The correction section 306 corrects the picture image data Cd and outputs the picture image data Vd for performing overdrive. The correction section 306 obtains data Corr0 and Corr1 outputted from the look-up table 305 and the data Move and the data Dir outputted from the motion determination section 303. If the value of the data Move is 0, the correction section 306 outputs as the picture image data Vd the obtained picture image data Cd as it is.

On the other hand, if the value of the data Move is 1, the correction section 306 corrects the picture image data Cd. Specifically, the correction section 306 calculates a correction amount H in accordance with Expression 1 below. Then, when the value of the data Dir is 0, the correction section 306 outputs as the picture image data Vd a value obtained by subtracting the correction amount H from the picture image data Cd, and if the value of the data Dir is 1, the correction section 306 outputs as the picture image data Vd a value obtained by adding the correction amount H to the picture image data Cd.

$$\text{Correction amount } H = (\text{Value of lower 6 bits of picture image data } Cd) * (\text{Data Corr1} - \text{Data Corr0})/64 + \text{Data Corr0} \quad \text{Expression 1}$$

Returning FIG. 1, the data line driver circuit 140 converts the obtained picture image data Vd to an analog data signal in accordance with control performed by the display control circuit 20, and supplies data signals X1 to Xn which have gone through the conversion to the pixels 110 of one row selected by the scanning line driver circuit 130 respectively via the data lines 114.

FIG. 3 depicts a voltage waveform illustrating an example of a data signal Vx when the picture image data Vd regarding the first row and the first column to the first row and the nth column are outputted in a horizontal scanning period (H). In this embodiment, the liquid crystal panel 100 is a normally black panel. Therefore, when the polarity designating signal FRP is at the high level (positive writing is performed), the data signal Vx has a voltage higher than the reference voltage Vcnt by an amount corresponding to the gray-scale level processed by the picture image processing circuit 30 (as indicated by an up arrow in FIG. 3), and when the polarity designating signal FRP is at the low level (negative writing is performed), the data signal Vx has a voltage lower than the reference voltage Vcnt by an amount corresponding to the gray-scale level processed by the picture image processing circuit 30 (as indicated by a down arrow in FIG. 3).

Specifically, the voltage of the data signal Vx ranges from a voltage Vw(+) corresponding to white to a voltage Vb(+) corresponding to black in positive writing while it ranges from a voltage Vw(−) corresponding to white to a voltage Vb(−) corresponding to black in negative writing, and is a voltage changed from the reference voltage by an amount corresponding to the gray-scale level in each of positive writing and negative writing. The voltage Vw(+) and the voltage Vw(−) are in a symmetrical relationship with respect to the voltage Vcnt, and the voltage Vb(+) and the voltage Vb(−) are in a symmetrical relationship with respect to the voltage Vcnt.

Note that FIG. 3 depicts the voltage waveform of the data signal Vx, and the data signal Vx has a different voltage from a voltage (a potential difference between the pixel electrode 118 and the common electrode 108) applied to the liquid crystal element 120. The scale of the ordinate axis for the voltage of the data signal Vx in FIG. 3 is enlarged, as compared to the voltage waveforms of the scanning signals, etc. in FIG. 3.

Next, the operation of the liquid crystal display device 1 will be described. The picture image data Cd is supplied from a host device to the pixels located at the first row and the first column to the first row and the last column, the second row and the first column to the second row and the last column, the third row and the first column to the third row and the last column, . . . , and the mth row and the first column and the mth row and the last column in this order during a vertical effective scanning period. The picture image data Cd for one frame is stored in the frame memory 40. The display control circuit 20 outputs the start pulse Dy at a start timing of a frame, i.e., a start timing of the first field. The display control circuit 20 also outputs the clock signal Cly to turn the polarity designating signal FRP to the high level. When the start pulse Dy is outputted, the picture image data Cd stored in the frame memory 40 is read out in the order of the first row and the first column to the first row and the last column, the second row and the first column to the second row and the last column, the third row and the first column to the third row and the last column, . . . , and the mth row and the first column and the mth row and the last column.

For example, when the picture image data Cd of the pixel 110 at the first row and the first column is supplied to the picture image processing circuit 30, the picture image data Cd is received by the size reducing section 301. The size reducing section 301 extracts 6 most significant bits of the obtained picture image data Cd and outputs as the data Cur1 the extracted 6-bit data. In this case, when the value of the picture image data Cd is, for example, 160 ("000010100000" in the binary representation), the value of the data Cur1 is 2.

The data Cur1 outputted from the size reducing section 301 is sent to the memory 304. Note that in the first field, the data Cur1 is not stored in the memory 304 and the data Cur1 regarding the pixel 110 located at the first row and the first column stored in the preceding frame located immediately before the current frame is outputted as the data Pre.

Next, in the motion determination section 303, comparison between the data Cur1 outputted from the size reducing section 301 and the data Pre outputted from the memory 304 is performed. In this case, for example, if the value of the data Pre is 1, the respective values of the data Cur1 and the data Pre are different from each other, and thus, the value of the data Move outputted from the motion determination section 303 is 1, and the value of the data Dir is 1.

The look-up table 305 receives the data Cur1 outputted from the size reducing section 301 and the data Pre outputted from the memory 304. In this case, because the value of the data Cur1 is 2 and the value of the data Pre is 1, the correction amount at the intersection of the column in which 2 is stored on the abscissa axis and the row in which 1 is stored on the ordinate axis is outputted as the data Corr0 and the correction amount at the intersection of the column in which 3 is stored on the abscissa axis and the row in which 1 is stored on the ordinate axis is outputted as the data Corr1.

Figure 7:
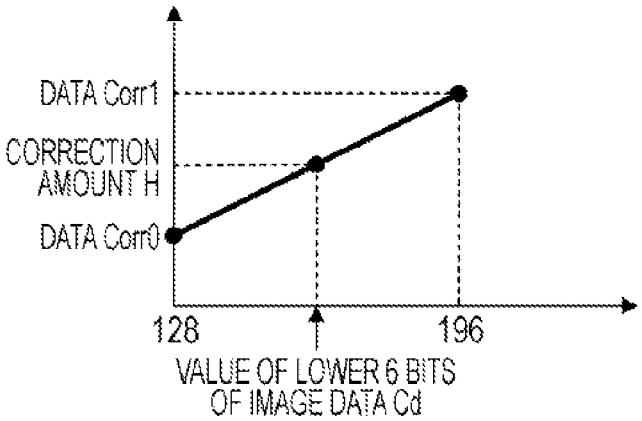
FIG. 7 is a graph illustrating linear interpolation performed by a correction section.

Next, in the correction section 306, correction is performed on the picture image data Cd. The correction amount H for the correction is calculated using Expression 1 described above. For example, when the value of the picture image data Cd is 160, the value of the lower 6 bits of the picture image data Cd is 32. Also, when the data Corr0 is 31 and the data Corr1 is 0, as illustrated in FIG. 7, the data Corr0 and the data Corr1 are linear interpolated to obtain the correction amount $H=32*(-31)/64+31\approx15.5$, and then, 15.5 is rounded off to the nearest whole number, so that the correction amount H=15 is obtained. Since the value of the data Dir is 1, 15 is added to the value of the picture image data Cd, i.e., 160 to obtain 175, and the value of the picture image data Vd is corrected to be 175 and the corrected value, i.e., 175 is outputted to the data line driver circuit 140.

Similarly, the picture image data Cd of the pixels 110 located at the first row and the second column to the first row and the nth column is processed by the picture image processing circuit 30, and the picture image data Vd regarding the pixels 110 located at the first row and the second column to the first row and the nth column is outputted to the data line driver circuit 140. In this case, since the polarity designating signal FRP supplied from the display control circuit 20 is at the high level, the data line driver circuit 140 converts the picture image data Vd to the analog data signal Vx having a higher potential than the reference voltage Vcnt and outputs the data signal Vx to the data lines 114.

For example, the data signal Vx obtained by converting the picture image data Vd regarding the first row and the first column is outputted to the data line 114 of the first column, and the data signal Vx obtained by converting the picture image data Vd regarding the first row and the second column is outputted to the data line 114 of the second column. In this case, when the voltage of the scanning line 112 of the first column is caused to be the selection voltage VH by the scanning line driver circuit 130, the TFTs 116 of the pixels 110 of the first row are turned on and the data signal Vx supplied to each of the data lines 114 is applied to the corresponding pixel electrodes 118. Thus, a positive voltage corresponding to the picture image data Vd is written to the corresponding liquid crystal elements 120 and is held.

Subsequently, in the first field, a similar voltage writing operation is performed sequentially on the second row to the mth row. Thus, a positive voltage that has gone through overdrive processing is written on the pixels 110 of the first to mth rows in accordance with the gray-scale level.

Then, when a time corresponding to one half of one frame has elapsed since the output of the start pulse Dy, the display control circuit 20 outputs the start pulse Dy again to turn the polarity designating signal FRP to the low level. When the start pulse Dy is outputted, the frame memory 40 is controlled, and the stored picture image data Cd of the current frame is read out in the order of the first row and the first column to the first row and the last column, the second row and the first column to the second row to the last column, the third row and the first column to the third row and the last column, . . . , and the mth row and the first column to the mth row and the last column.

In the picture image processing circuit 30, when the picture image data Cd of the pixel 110 located at the first row and the first column is supplied to the picture image processing circuit 30, similar to the first field, the data Cur1 is outputted. The data Cur1 outputted from the size reducing section 301 is sent to the memory 304. Note that in the second field, the data Cur1 regarding the pixel 110 located at the first row and the first column stored in the preceding frame located immediately before the current frame is read out from the memory 304 and is outputted as the data Pre, and new data Cur1 is stored in the memory 304.

Next, in the motion determination section 303, similar to the first field, comparison between the data Cur1 and the data Pre is performed, and the data Move and the data Dir are outputted. Also, similar to the first field, the data Cur1 and the data Pre are received by the look-up table 305 and the data Corr0 and the data Corr1 are outputted. Similar to the first field, the picture image data Vd is generated in the correction section 306 and is outputted.

In this case, since the polarity designating signal FRP supplied from the 20 is at the low level, the data line driver circuit 140 converts the picture image data Vd to the analog data signal Vx having a lower potential than the reference voltage Vcnt and outputs the data signal Vx to the data lines 114.

Then, when the voltage of the scanning line 112 of the first row is caused to be the selection voltage VH by the scanning line driver circuit 130, the TFTs 116 of the pixels 110 of the first row are turned on and the data signal Vx supplied to each of the data lines 114 is applied to the corresponding pixel electrodes 118. Thus, a negative voltage corresponding to the picture image data Vd is written to the corresponding liquid crystal elements 120 and is held.

In subsequent frames, on the basis of the picture image data Cd sequentially written to the frame memory 40, a positive writing operation is performed sequentially on the first to mth rows in the first field. Thus, a positive voltage that has gone through overdrive processing is written to the pixels 110 of the first to mth rows in accordance with the gray-scale level. In the second field, a negative writing operation is sequentially performed on the first to mth rows. Thus, a negative voltage that has gone through overdrive processing is written to the pixels 110 of the first to mth rows in accordance with the gray-scale level.

Figure 8:
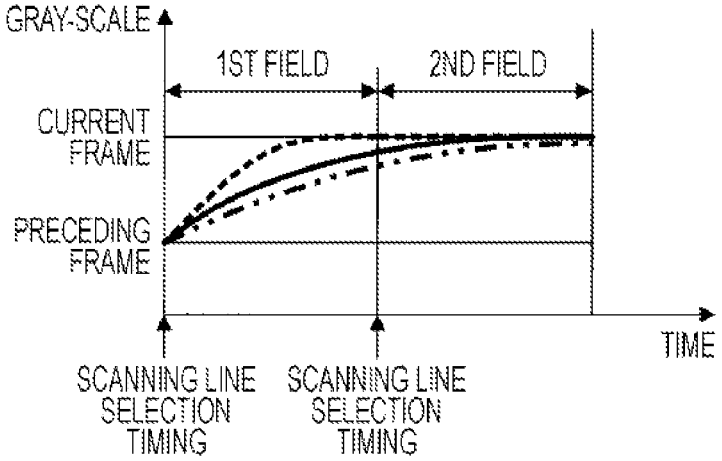
FIG. 8 is a diagram illustrating change in gray-scale.

FIG. 8 is a diagram illustrating a difference between change in gray-scale level with time in this embodiment and change in gray-scale level with time in some other configuration for a single pixel 110. When overdrive processing is not performed, there might be cases, as indicated by the chain-double dashed line in FIG. 8, the gray-scale level of the pixel 110 does not change to the gray-scale level for the current frame designated by the picture image data Cd by the time when the current frame ends and is lower than the designated gray-scale level. Also, as described in the Related Art section, when overdrive processing is performed only in one field, as indicated by the dotted line in FIG. 8, the gray-scale level of the pixel 110 changes to a target gray-scale level, i.e., the gray-scale level of the current frame before the second field starts. However, there might be cases where the correct amount for overdrive in the subsequent frame immediately located after the current frame is not the same as the correction amount of the current frame, and thus, a DC component might be applied to the liquid crystal.

To avoid such cases, in this embodiment, overdrive processing is performed in the first field, and a voltage is applied to the liquid crystal element 120 by positive writing. In the second field also, overdrive processing is performed, and a voltage is applied to the liquid crystal element 120 by negative writing. When comparing the first field with the second field, voltages to be written to the liquid crystal element 120 in the first and second fields are in a symmetrical relationship with respect to the voltage Vcnt, and therefore, the probability of a DC component being applied to the liquid crystal may be reduced. Moreover, since overdrive processing is performed in the first field and the second field, as indicated by the solid line in FIG. 8, the gray-scale level of the pixel changes to a target gray-scale level, i.e., the gray-scale level of the current frame before a subsequent frame starts.

Second Embodiment

Next, a second embodiment of the present disclosure will be described. A liquid crystal display device according to the second embodiment has the same hardware configuration as that of the first embodiment. The liquid crystal display device of the second embodiment is different from that of the first embodiment in that timings of the start pulse Dy and the polarity designating signal FRP are different from those in the first embodiment and in that overdrive processing is not performed in all fields. The second embodiment will be hereinafter described with focus on the above-described differences.

Figure 9:
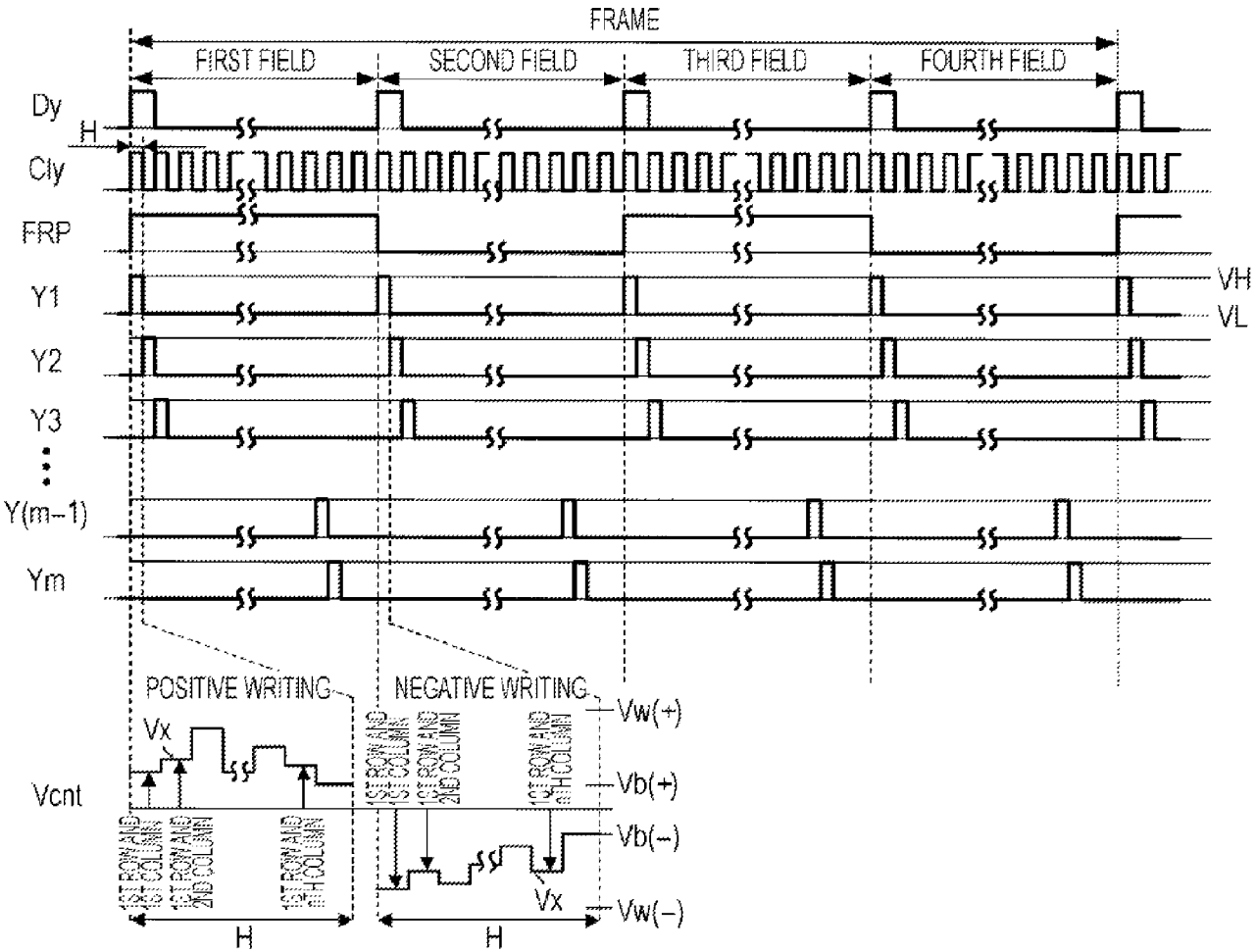
FIG. 9 is a timing chart of signals that drive the liquid crystal panel according to a second embodiment.

FIG. 9 is a timing chart illustrating the relationship among the voltage of each scanning line 112, the start pulse Dy, the clock signal Cly, the polarity designating signal FRP, and scanning signals Y1 to Ym for applying a selection voltage VH and a non-selection voltage VL to the scanning lines 112. As illustrated in FIG. 9, in the liquid crystal display device 1 of the second embodiment, one frame is divided into 2n fields (n is an integer of 1 or larger), specifically, four fields, i.e., first to fourth fields. In this case, if the vertical scanning frequency of the synchronization signal Sync is 60 Hz, the period of one frame is about 16.7 ms, and a period of one field is about 4.16 ms.

In each field, the scanning lines 112 of the first to mth rows are sequentially selected. That is, in one frame period, each of the scanning lines 112 is selected four times. Thus, in the liquid crystal display device 1, four-times speed driving is realized, and the liquid crystal display device 1 drives the liquid crystal panel 100 at a driving speed of 240 Hz on the basis of the picture image data Cd supplied from a host device at a supply speed of 60 Hz, thereby displaying an image of one film frame on the basis of the picture image data Cd.

In the second embodiment, the level of the polarity designating signal FRP changes in each field. In the first field and the third field, the polarity designating signal FRP is turned to the high level, and in the second field and the fourth field, the polarity designating signal FRP is turned to the low level. That is, a writing polarity is inverted in each field and data writing to the pixel 110 is performed. Note that the polarity designating signal FRP may be turned to the low level in the first field and the third field and to the high level in the second field and the fourth field.

Next, the operation of the liquid crystal display device 1 according to this embodiment will be described. Similar to the first embodiment, picture image data Cd supplied from the host circuit is stored in the frame memory 40. The display control circuit 20 outputs a start pulse Dy and a clock signal Cly and causes the polarity designating signal FRP to be the high level. When the start pulse Dy is outputted, the picture image data Cd stored in the frame memory 40 is read out in the order of the first row and the first column to the first row and the last column, the second row and the first column to the second row and the last column, the third row and the first column to the third row and the last column, . . . , and the mth row and the first column to the mth row and the last column.

In the picture image processing circuit 30, similar to the first field of the first embodiment, overdrive processing is performed, and the picture image data Vd is outputted to the data line driver circuit 140. In this case, since the polarity designating signal FRP supplied from the display control circuit 20 is at the high level, the data line driver circuit 140 converts the picture image data Vd to the analog data signal Vx having a potential higher than the reference voltage Vcnt and outputs the data signal Vx to the data lines 114. Then, when the voltage of the scanning line 112 is caused to be the selection voltage VH by the scanning line driver circuit 130, the TFTs 116 of the pixels 110 to which the selection voltage VH has been applied are turned on and the data signal Vx supplied to each of the data lines 114 is applied to the corresponding pixel electrodes 118. Thus, a positive voltage corresponding to the picture image data Vd is written to the corresponding liquid crystal elements 120 and is held.

Next, when a time corresponding to one fourth of one frame has elapsed since the output of the start pulse Dy, the display control circuit 20 outputs the start pulse Dy again to turn the polarity designating signal FRP to the low level. When the start pulse Dy is outputted, the picture image data Cd of the current frame stored in the frame memory 40 is read out again.

In the picture image processing circuit 30, similar processing to the processing performed in the second field in the first embodiment is performed, and the picture image data Vd is outputted to the data line driver circuit 140. In this case, since the polarity designating signal FRP supplied from the display control circuit 20 is at the low level, the data line driver circuit 140 converts the picture image data Vd to the analog data signal Vx having a potential lower than the reference voltage Vcnt and outputs the data signal Vx to the data lines 114.

Then, when the voltage of the scanning line 112 is caused to be the selection voltage VH by the scanning line driver circuit 130, the TFTs 116 of the pixels 110 to which the selection voltage VH has been applied are turned on and the data signal Vx supplied to each of the data lines 114 is applied to the corresponding pixel electrodes 118. Thus, a negative voltage corresponding to the picture image data Vd is written to the corresponding liquid crystal element 120 and is held.

Note that in the second field, reading-out of the data Cur1 regarding the preceding frame located immediately before the current frame stored in the memory 304 and writing of the data Cur1 supplied from the size reducing section 301 to the memory 304 are simultaneously performed. To simultaneously perform writing of data to a memory and reading-out of data from the memory, for example, a dual-port memory may be used.

Next, when a time corresponding to one half of one frame has elapsed since the output of the start pulse Dy, the display control circuit 20 outputs the start pulse Dy again to turn the polarity designating signal FRP to the high level. When the start pulse Dy is outputted, the picture image data Cd of the current frame stored in the frame memory 40 is read out again. In this case, 6 most significant bits of the picture image data of the current frame are stored in the memory 304, and therefore, the value of data Move outputted from the motion determination section 303 is 0. Thus, in the third field, the picture image data Cd, as it is, is outputted as the picture image data Vx. That is, overdrive processing is not performed.

When the picture image data Vx is supplied to the data line driver circuit 140, the data line driver circuit 140 converts the picture image data Vd to the analog data signal Vx having a potential higher than the reference voltage Vcnt and outputs the data signal Vx to the data lines 114 since the polarity designating signal FRP is at the high level in the third field. Then, when the voltage of the scanning line 112 is caused to be the selection voltage VH by the scanning line driver circuit 130, a positive voltage corresponding to the picture image data Vd is written to the liquid crystal element 120 and is held.

When a time corresponding to three fourth of one frame has elapsed since the output of the start pulse Dy, the display control circuit 20 outputs the start pulse Dy again to turn the polarity designating signal FRP to the low level. When the start pulse Dy is outputted, the picture image data Cd of the current frame stored in the frame memory 40 is read out again. In this case also, 6 most significant bits of the picture image data of the current frame are stored in the memory 304, and therefore, the value of data Move outputted from the motion determination section 303 is 0 as in the third field. Thus, in the fourth field, the picture image data Cd, as it is, is outputted as the picture image data Vx. That is, overdrive processing is not performed.

When the picture image data Vx is supplied to the data line driver circuit 140, the data line driver circuit 140 converts the picture image data Vd to the analog data signal Vx having a potential lower than the reference voltage Vcnt and outputs the data signal Vx to the data lines 114 since the polarity designating signal FRP is at the low level in the fourth field. Then, when the voltage of the scanning line 112 is caused to be the selection voltage VH by the scanning line driver circuit 130, a negative voltage corresponding to the picture image data Vd is written to the liquid crystal elements 120 and is held.

Figure 10:
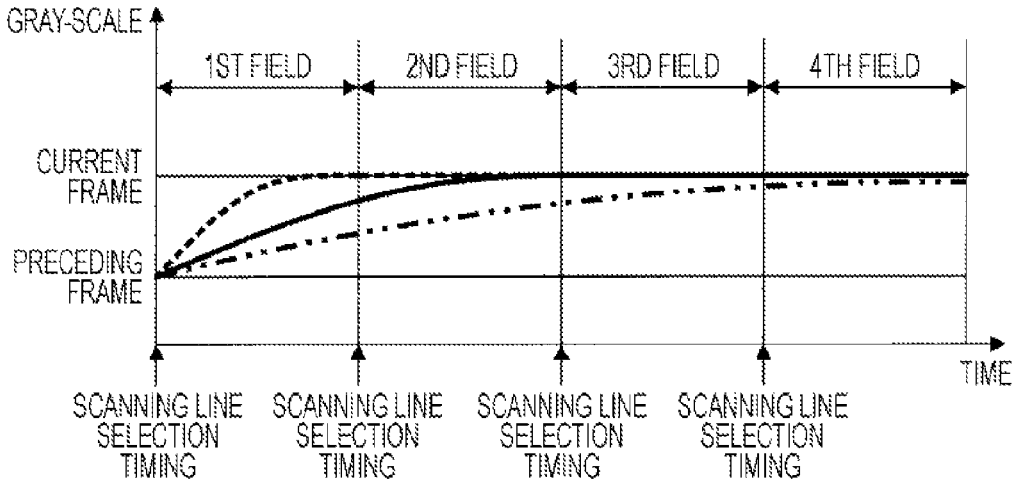
FIG. 10 is a diagram illustrating change in gray-scale according to the second embodiment.

FIG. 10 is a diagram illustrating a difference between change in gray-scale level with time in this embodiment and change in gray-scale level with time in some other configuration for a single pixel 110. When overdrive processing is not performed, there might be cases, as indicated by the chain-double dashed line in FIG. 10, the gray-scale level of the pixel 110 does not change to the gray-scale level for the current frame designated by the picture image data Cd by the time when the current frame ends and is lower than the designated gray-scale level. Also, as described in the Related Art section, when overdrive processing is performed only in one field, as indicated by the dotted line in FIG. 10, the gray-scale level of the pixel 110 changes to a target gray-scale level, i.e., the gray-scale level for the current frame before the second field starts. However, there might be cases where the correct amount for overdrive in the subsequent frame located immediately after the current frame is not the same as the correction amount of the current frame, and thus, a DC component might be applied to the liquid crystal.

To avoid such cases, in this embodiment, overdrive processing is performed in the first field, and a voltage is applied to the liquid crystal element 120 by positive writing. In the second field also, overdrive processing is performed, and a voltage is applied to the liquid crystal element 120 by negative writing. When comparing the first field with the second field, the voltages to be written to the liquid crystal element 120 in the first and second fields are in a symmetrical relationship with respect to the voltage Vcnt, and therefore, the probability of a DC component being applied to the liquid crystal may be reduced. Moreover, since overdrive processing is performed in the first field and the second field, as indicated by the solid line in FIG. 10, the gray-scale level of the pixel changes to a target gray-scale level, i.e., the gray-scale level of the current frame before a subsequent frame starts.

Electronic Equipment

Figure 11:
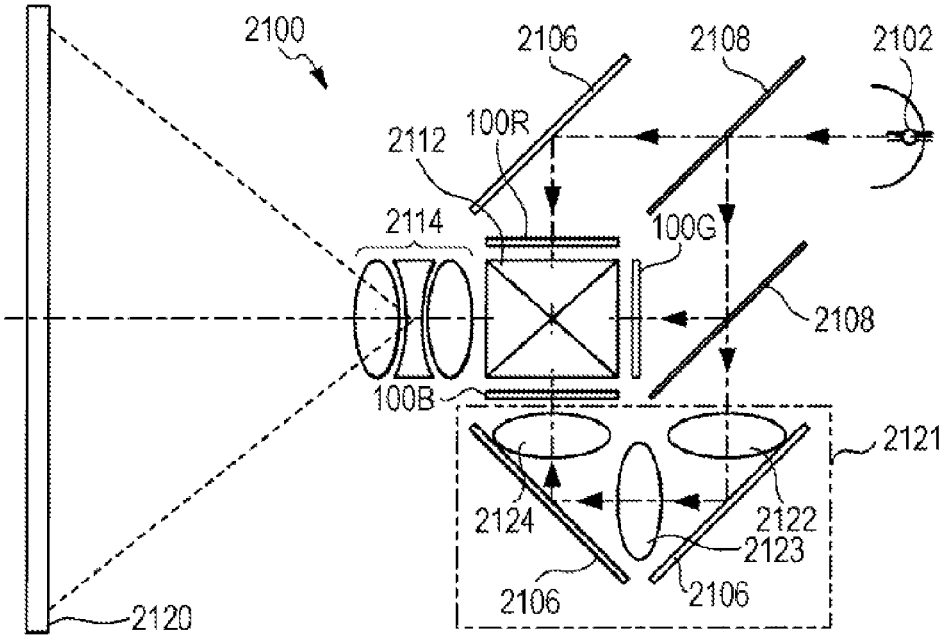
FIG. 11 is a view illustrating an example electronic equipment.

Next, an example electronic equipment using the liquid crystal display device 1 of the above-described embodiment will be described. FIG. 11 is a plan view illustrating a configuration of a three-panel projector using the liquid crystal panel 100 of the liquid crystal display device 1 described above as a light valve. A lamp unit 2102 including a white light source such as a halogen lamp or the like is provided inside a projector 2100. In the projector 2100, a light outputted from the lamp unit 2102 is split into three primary colors of red (R), green (G), and blue (B) by three mirrors 2106 arranged therein and two dichroic mirrors 2108, and the three colors are guided to light valves 100R, 100G, and 100B corresponding to the primary colors, respectively. Note that the B light has a longer optical path than those of the other color lights, i.e., the R light and the G light and, in order to reduce loss of the B light, the B light is guided through a relay lens system formed of an input lens 2122, a relay lens 2123, and an output lens 2124.

Each of the light valves 100R, 100G, and 100B has the same configuration as that of the liquid crystal panel 100 of the above-described embodiment, and is driven by an image data Cd of a corresponding one of the colors R, G, and B supplied from an external host device (not shown). Light modulated by the light valves 100R, 100G, and 100B enters a dichroic prism 2112 from three directions. In the dichroic prism 2112, the R light and the B light are reflected at an angle of 90 degrees, but the G light progresses straight. Therefore, images of the RGB colors are synthesized, and then, a color image is projected on an enlarged scale in a forward direction by the lens unit 2114. Thus, the color image is displayed on a screen 2120.

While images passing through the light valves 100R and 100B are reflected by the dichroic prism 2112 and then are projected, an image passing through the light valve 100G is projected as it is. Thus, images formed by the light valves 100R and 100B are mirror-reversed with respect to an image formed by the light valve 100G.

Note that examples of an electronic equipment includes, in addition to the projector, a rear-projection-type television, a direct-view-type display, monitors of, for example, a mobile phone, a personal computer, and a video camera, a car navigation system, a pager, an electronic organizer, an electronic calculator, a word processor, a work station, a videophone, a point of sales (POS) terminal, a digital still camera, and an apparatus with a touch panel, etc. An electro-optical device according to the present disclosure may be applied to these various types of electronic equipments.

Variations

While embodiments of the present disclosure have been described above, the present disclosure is not limited to the above-described embodiments and can be implemented in various other forms. For example, the present disclosure may be implemented by modifying the above-described embodiments in the following manner. Note that the above-described embodiments and the following variations may be combined.

In the first embodiment described above, the number of fields in one frame is 2, and in the second embodiment, the number of the fields in one frame is 4. However, the number of fields is not limited thereto but may be 2n, i.e., for example, 6 and 8, etc.

In this case, in one half of 2n fields, positive writing is performed, and on the other half of the 2n fields, a negative writing is performed. Moreover, in a plurality of predetermined fields among the 2n fields, overdrive processing is performed, and in the fields in which overdrive is performed, the number of fields in which positive writing is performed and the number of fields in which negative writing is performed are the same.

Figure 12:
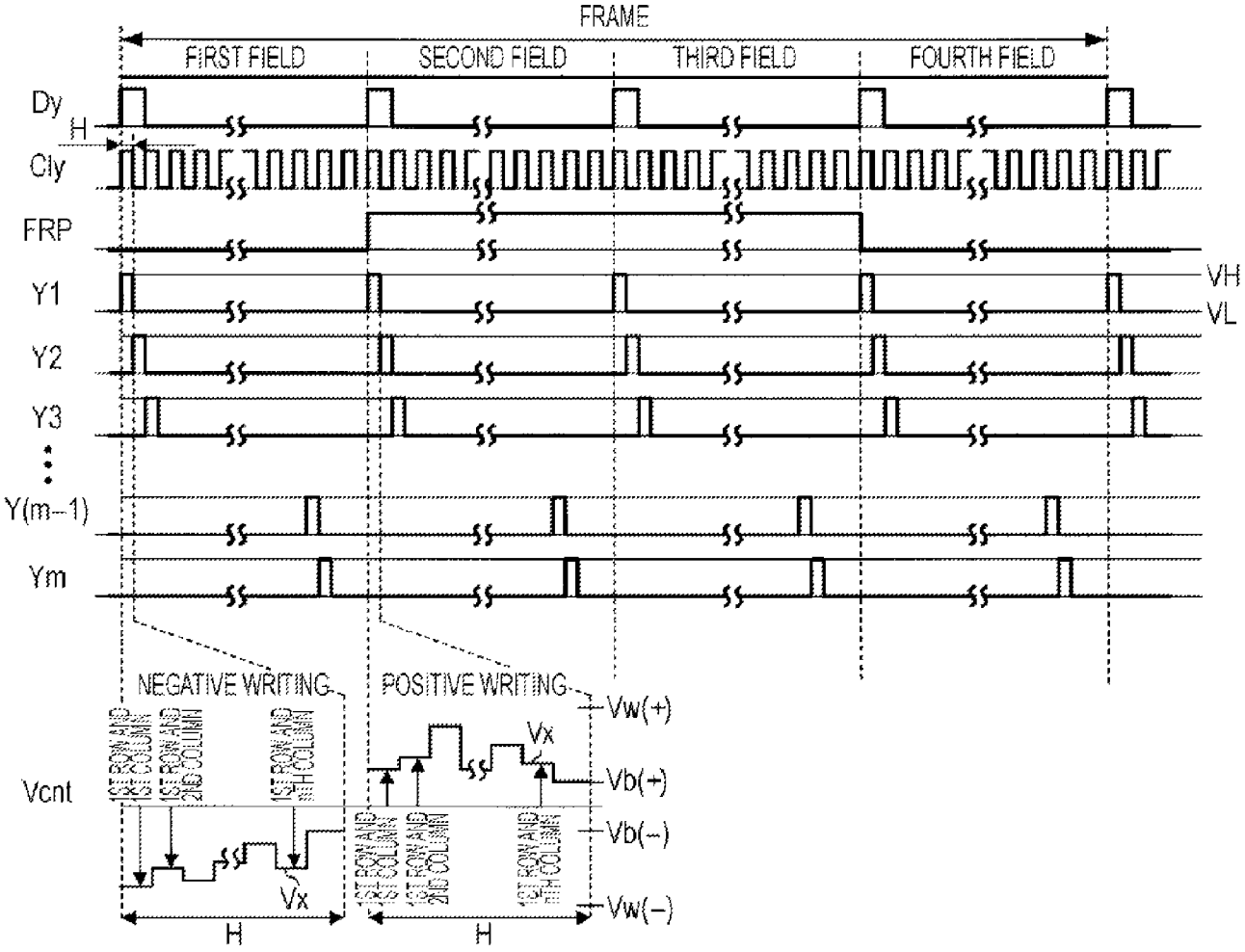
FIG. 12 is a timing chart of signals that drive the liquid crystal panel according to a variation.

In the configuration in which one frame is divided into four fields, as illustrated in FIG. 12, the polarity designating signal FRP may be turned to the low level in the first field and the fourth field, the polarity designating signal FRP may be turned to the high level in the second field and the third field, and overdrive processing may be performed in the first field and the second field.

As in the second embodiment, in the case where the polarity designating signal FRP is outputted as illustrated in FIG. 9, overdrive processing may be performed in the second field and the third field, but not in the other fields.

In the above-described embodiments, the data Cur1 is 6 most significant bits of the picture image data Cd. However, the bit number of the data Cur1 is not limited to 6 bits. For example, the data Cur1 may be 5 most significant bits of the picture image data Cd, and also may be 7 most significant bits thereof. Note that when the bit number of the data Cur1 is some number other than 6, the expression used for obtaining the correction amount H and the contents of the look-up table 305 are appropriately changed.

In the above-described embodiments, a configuration in which providing the size reducing section 301 is not provided, the memory 304 stores the picture image data Cd, and the motion determination section 303 performs comparison of the picture image data Cd between a current frame and a preceding frame may be adopted. Note that in this configuration, when the picture image data Cd is 12 bit data, the numbers of rows and columns in the lookup table is, for example, 4096 rows×4096 columns.

In the above-described embodiments, the liquid crystal panel 100 is a normally black panel, but may be a normally white panel. Also, in the above-described embodiments, the display device is the liquid crystal element 120 using a liquid crystal, but may be a display device using a material, such as an organic electro luminescence (EL), other than a liquid crystal.

When data writing to the memory 304 is performed, the data Cur1 may be written after clocks for data writing and data reading are controlled and the data Pre is read out in one field. Data may be written to the memory 304 in the last field in a frame.

This application claims priority to Japan Patent Application No. 2011-287145 filed Dec. 28, 2011, the entire disclosures of which are hereby incorporated by reference in their entireties.

What is claimed is:

1. A driver unit that drives an electro-optical device including a plurality of pixels, the driver unit comprising:
- a signal processing section; and
- a correction amount storage section that stores a plurality of correction amounts corresponding to a plurality of combinations of gray-scale levels,
- wherein
  - a first image signal supplied to the signal processing section designates a first gray-scale level of a first pixel among the plurality of pixels during a first frame,
  - a second image signal supplied to the signal processing section designates a second gray-scale level of the first pixel during a second frame subsequent to the first frame,
  - the signal processing section
    - obtains first correction data from the correction amount storage section, the first correction data corresponding to a combination of the first gray-scale level and the second gray-scale level,
    - obtains second correction data from the correction amount storage section, the second correction data corresponding to a combination of the first gray-scale level and a third gray-scale level,
    - determines a correction amount based on the first correction data and the second correction data,
    - corrects the second image signal, based on the correction amount, to a third image signal that designates a fourth gray-scale level that is different from the first gray-scale level and the second gray-scale level to generate a first overdrive signal and a second overdrive signal, each corresponding to the third image signal,
    - supplies the first overdrive signal to the first pixel during a first period of the second frame, and
    - supplies the second overdrive signal to the first pixel during a second period of the second frame,
  - one of the first overdrive signal and the second overdrive signal has a potential higher than a predetermined potential,
  - the other one of the first overdrive signal and the second overdrive signal has a potential lower than the predetermined potential,
  - during the first frame a first image is displayed,
  - during the second frame a second image that is different from the first image is displayed, and
  - the potential of the first overdrive signal supplied to the first pixel during the first period of the second frame and the potential of the second overdrive signal supplied to the first pixel during the second period of the second frame are in a symmetrical relationship with respect to the predetermined potential.

2. The driver unit according to claim 1, wherein
- the first pixel holds the first overdrive signal during the first period, and
- the first overdrive signal held by the first pixel during the first period changes to the second overdrive signal during the second period.

3. The driver unit according to claim 1,
- wherein the first period and the second period are included in one frame set for the first pixel.

4. The driver unit according to claim 1, further comprising:
- an image signal storage section that stores the first image signal.

5. The driver unit according to claim 1, wherein
- the correction amount storage section stores correction amounts corresponding to the first gray-scale level and the second gray-scale level in advance, and
- the signal processing section corrects the second image signal and the third image signal on the basis of the correction amounts stored by the correction amount storage section.

6. An electro-optical device comprising:
- the driver unit according to claim 1.

7. An electronic apparatus comprising:
- the electro-optical device according to claim 6.

8. The driver unit according to claim 1, wherein
- one of the first gray-scale level and the second gray-scale level has a potential higher than a predetermined potential, and
- the other one of the first gray-scale level and the second gray-scale level has a potential lower than the predetermined potential.

9. A driver unit that drives an electro-optical device including a plurality of pixels, the driver unit comprising:
- a signal processing section; and
- a correction amount storage section that stores a plurality of correction amounts corresponding to a plurality of combinations of gray-scale levels,
- wherein
  - a first image signal supplied to the signal processing section designates a first gray-scale level of a first pixel among the plurality of pixels during a first frame,
  - a second image signal supplied to the signal processing section designates a second gray-scale level of the first pixel during a second frame subsequent to the first frame,
  - the signal processing section
    - obtains first correction data from the correction amount storage section, the first correction data corresponding to a combination of the first gray-scale level and the second gray-scale level,
    - obtains second correction data from the correction amount storage section, the second correction data corresponding to a combination of the first gray-scale level and a third gray-scale level,
    - determines a correction amount based on the first correction data and the second correction data, corrects the second image signal, based on the correction amount, to a third image signal that designates a fourth gray-scale level that is different from the first gray-scale level and the second gray-scale level to generate a first overdrive signal and a second overdrive signal, each corresponding to the third image signal, and a third overdrive signal and a fourth overdrive signal, each corresponding to the second image signal, supplies the first overdrive signal to the first pixel during a first period of the second frame, supplies the second overdrive signal to the first pixel during a second period of the second frame, supplies the third overdrive signal to the first pixel during a third period of the second frame, and supplies the fourth overdrive signal to the first pixel during a fourth period of the second frame, one of the first overdrive signal and the second overdrive signal has a potential higher than a predetermined potential, the other one of the first overdrive signal and the second overdrive signal has a potential lower than the predetermined potential, one of the third overdrive signal and the fourth overdrive signal has a potential higher than the predetermined potential, the other one of the third overdrive signal and the fourth overdrive signal has a potential lower than the predetermined potential, during the first frame a first image is displayed, during the second frame a second image that is different from the first image is displayed, the potential of the first overdrive signal supplied to the first pixel during the first period of the second frame and the potential of the second overdrive signal supplied to the first pixel during the second period of the second frame are in a symmetrical relationship with respect to the predetermined potential, and the potential of the third overdrive signal supplied to the first pixel during the third period of the second frame and the potential of the fourth overdrive signal supplied to the first pixel during the fourth period of the second frame are in a symmetrical relationship with respect to the predetermined potential.

10. The driver unit according to claim 9, wherein the first pixel holds the first overdrive signal during the first period, the first overdrive signal held by the first pixel during the first period is changed to the second overdrive signal during the second period, the second overdrive signal held by the first pixel during the second period is changed to the third overdrive signal during the third period, and the third overdrive signal held by the first pixel during the third period is changed to the fourth overdrive signal during the fourth period.

11. A method for driving an electro-optical device including a plurality of pixels, the electro-optical device including a signal processing section, the method comprising:

storing a plurality of correction amounts corresponding to a plurality of combinations of gray-scale levels, supplying, to the signal processing section, a first image signal that designates a first gray-scale level of a first pixel among the plurality of pixels during a first frame, supplying, to the signal processing section, a second image signal that designates a second gray-scale level of the first pixel during a second frame subsequent to the first frame, obtaining, from the stored plurality of correction amounts, first correction data corresponding to a combination of the first gray-scale level and the second gray-scale level, obtaining, from the stored plurality of correction amounts, second correction data corresponding to a combination of the first gray-scale level and a third gray-scale level, determining a correction amount based on the first correction data and the second correction data, correcting the second image signal, based on the correction amount, to a third image signal that designates a fourth gray-scale level that is different from the first gray-scale level and the second gray-scale level to generate a first overdrive signal and a second overdrive signal, each corresponding to the third image signal, supplying the first overdrive signal to the first pixel during a first period of the second frame, and supplying the second overdrive signal to the first pixel during a second period of the second frame, wherein one of the first overdrive signal and the second overdrive signal has a potential higher than a predetermined potential, the other one of the first overdrive signal and the second overdrive signal has a potential lower than the predetermined potential, during the first frame a first image is displayed, during the second frame a second image that is different from the first image is displayed, and the potential of the first overdrive signal and the potential of the second overdrive signal are in a symmetrical relationship with respect to the predetermined potential.

12. An electro-optical device comprising:

the driver unit according to claim 9.

13. An electronic apparatus comprising:

the electro-optical device according to claim 12.

14. An electro-optical device comprising:

the driver unit according to claim 10.

* * * * *